United States Patent [19]

Hook

[11] 3,937,233

[45] Feb. 10, 1976

[54] HAIR CURLER ASSEMBLY

[76] Inventor: John W. Hook, 3880 State, Abilene, Tex. 79603

[22] Filed: Mar. 10, 1975

[21] Appl. No.: 557,076

[52] U.S. Cl. ..... 132/40
[51] Int. Cl.[2] ..... A45D 2/00
[58] Field of Search ..... 132/40, 41, 42; 24/16

[56] References Cited

UNITED STATES PATENTS

| | | | |
|---|---|---|---|
| 2,450,560 | 10/1948 | Redward et al. | 132/40 |
| 2,732,845 | 1/1956 | Winkler | 132/42 |
| 2,758,604 | 8/1956 | Graf | 132/41 R |
| 2,763,270 | 9/1956 | Carey | 132/40 |
| 2,941,534 | 6/1960 | Otto et al. | 132/41 R |
| 3,003,505 | 10/1961 | Otto et al. | 132/41 R |
| 3,397,430 | 8/1968 | Pearl | 24/16 |
| 3,500,837 | 3/1970 | Ferens | 132/40 |

*Primary Examiner*—G. E. McNeill
*Attorney, Agent, or Firm*—Peter J. Murphy

[57] ABSTRACT

The roller body is an elongated, generally cylindrical hollow member having one closed end, with the end wall having a small central aperture. The body is fabricated of a lightweight, heat insulating material such as Styrofoam. The fastening member is a plastic strap having a head at one end to be secured in the body end wall aperture, and having a hook at the opposite end of the strap to be hooked over the body lip at the open end when the strap is passed over the hair rolled on the roller body.

10 Claims, 4 Drawing Figures

HAIR CURLER ASSEMBLY

BACKGROUND AND SUMMARY OF THE INVENTION

This invention relates to a hair curler enabling preassembly of the roller body and fastener member prior to use, and more particularly to a hair curler providing maximum convenience of use for both the wearer and the hairdresser.

There are a number of disadvantages in the use of presently available hair curler assemblies. Some roller bodies include metal wire coils, and other curlers require the use of metal clips for securing the curler after the curl is rolled. Such curlers, involving the use of metal parts, absorb heat under a hair dryer and frequently result in severe discomfort to the wearer and occasionally burns of the scalp. Additionally the absorption of heat by metal parts adds to discomfort by lengthening the hair drying time. Some curler assemblies are relatively heavy; and this results in considerable discomfort and even headaches to the wearer due to the weight carried on the head over an extended drying period which may average about 45 minutes.

For some curler assemblies having cylindrical roller bodies, the body absorbs considerable heat, and this is a disadvantage from the standpoint of heat loss, and further from the standpoint that this absorbed heat effects too rapid drying of the course of hair shafts immediately adjacent to the roller body and resultant uneven drying of the hair curl. For other assemblies the body may be made of moisture absorbing material (such as sponge rubber), requiring additional drying time to first dry out the roller body. Some curler assemblies require the use of plastic stab pins for securing the curler after the curl is rolled and these raise the possibility of injury to the scalp in use, by way of abrasion or laceration. The use of spring clips, metal or otherwise, for securing the curler after rolling the hair creates a flat area on the curl which is sometimes difficult to cover up with certain hair styles.

Another disadvantage of some hair curler assemblies is that their construction encourages entrappment of bacteria, increasing the problem of sanitation and encouraging transmittal of infection or disease from one customer to another if proper sanitation procedures are not practiced in commercial hairdressing establishments.

A principal object of this invention is to provide a novel hair curler assembly which obviates the disadvantages of presently available hair curler assemblies as above discussed.

Another principal object of this invention is to provide a novel hair curler assembly which can be manufactured and marketed at low cost, to encourage disposal after a single use and obviate sanitation problems.

Another object of this invention is to provide a very lightweight hair curler assembly for maximum user comfort.

A further object of this invention is to provide a unique curler assembly of roller body and fastener strap, wherein the components can be conveniently packaged unassembled for ready assembly prior to use. An ancillary object is to provide an assembly wherein the fastener strap is assembled to the roller body prior to use for the convenience of the hairdresser.

Still another object of this invention is to provide a novel hair curler assembly which obviates injury to the scalp by way of burns, abrasions or lacerations.

These objects are accomplished in a hair curler assembly comprising a generally cylindrical, hollow curler body and an elongated fastener. The curler body has one end wall and one open end, with the end wall being provided with a small central opening. The fastener strap has head means at one end dimensioned to be forced through the wall opening and to be retained by the end wall, with the other end having a hook member for engagement with the body cylindrical wall at its open end. The curler body is preferably made from an open celled, lightweight, heat insulating material with the fastener strap being fabricated from a sheet plastic material.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
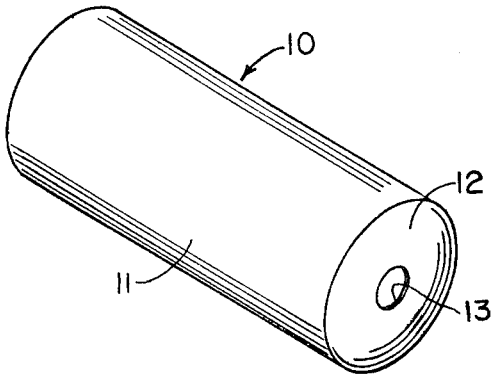
FIG. 1 is a perspective view of a roller body according to the invention.

Referring to the drawing, the curler assembly consists of a roller body 10 and a fastener strap 20. The roller body is a hollow body consisting of a generally cylindrical wall 11, an end wall 12 which closes one end of the body with the exception of a central opening 13, and the other end of the roller body being open. By way of typical dimension, this curler body may have a length of about 2½ inches and a diameter of about 1 inch, with the opening 13 being relatively small as described subsequently. The curler body is preferably fabricated of a material which is resistant to heat conduction, which is moisture resistant and which is very lightweight. Additionally the body may be provided with a heat reflective and a moisture repelling exterior surface, such as a glazed surface. A preferred form of material for the body 10 is an expanded synthetic resinous material, Styrofoam being one example. A specific form of material is glazed Styrofoam of the type used in the manufacture of molded hot and cold drinking cups. Roller bodies of this material may have only one-fourth the weight of conventional roller bodies. Alternatively, the roller body may be fabricated from a cellulose or fibrous material, such as a paper or cardboard type material. Preferably the body material should be capable of being molded, to facilitate the production of roller bodies at minimum cost.

Figure 2:
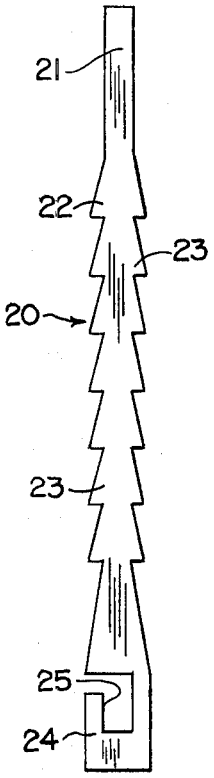
FIG. 2 is a view of a fastener strap prior to assembly with the roller body.
Figure 3:
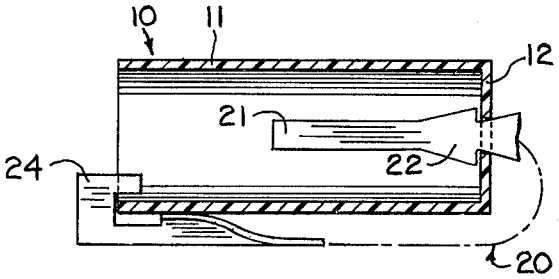
FIG. 3 is a cross-sectional view of the roller body in a diametral plane, showing the assembly of the roller body and fastener strap.
Figure 4:
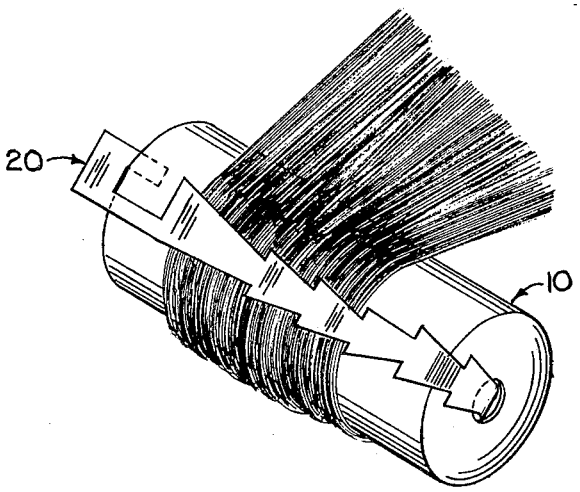
FIG. 4 is a view of the roller assembly of the invention securing a rolled curl.

A preferred form of fastener 20 may be fabricated from sheet plastic material, such as a vinyl plastic having a thickness of about 1/32 inch for example. In FIG. 2 such a fastener is viewed from one side and, in relation to a roller body, as above described, may have an overall length of about 5 inches and a maximum width of ½ inch. As seen in FIG. 2, the fastener strap is provided with serrated edges, intermediate its ends; and defines a lead 21 of reduced width, a first head 22 adjacent to the lead end, successive spaced enlargements or heads 23 along the intermediate portion of the strap, and a hook 24 at the opposite end of the strap formed by a cut-out slot 25. In the fabrication of fastener straps 20, these may be conveniently fabricated from sheet plastic material wherein the outlines of the straps are scored with the cut-outs 25 punched, so that a quantity of such straps may be conveniently packaged in sheet form to be readily separated into individual straps by the user.

By way of example the minimum width of the neck portions of the serrations may be about ¼ inch for example; and in relation to this the roller body opening 13 may have a diameter slightly in excess of ¼ inch. In the assembly of the fastener strap to the body as illustrated in FIG. 2, the head 22 may be forced through the opening 13 with the head deforming to allow entrapment inside the body with the strap then being retained by the end wall. This assembly would preferably be made prior to use of the curler, and during the rolling of the curl the strap due to its inherent stiffness would remain generally axially aligned with the curler axis and out of the way. When the curl is rolled the strap is readily available to be attached as illustrated in FIG. 2 by hooking the hook 24 over the lip of the cylindrical wall 11 at the body open end. This will securely hold the curler assembly in place with the fastener being relatively loose to avoid excessive compression of the curl resulting in a flat on the curl or damage to the hair. Should the fastener strap be too loose, the strap can be further forced through the body opening 13 to pass one or more of the heads 23 into the interior of the body.

Where the roller body is fabricated from a readily frangible material such as the above mentioned Styrofoam, the strap head may actually penetrate the end wall forming slot extensions of the opening 13; and due to the inherent friction between the body slot and strap, the strap will be retained to adequately secure the assembly after the curl is rolled.

Alternatively the fastener straps may be fabricated from a material other than plastic, such as fibrous paper or cardboard type material or any other suitable sheet material.

What has been described is a unique and effective hair curler assembly which can be easily fabricated from readily available materials and which can be fabricated by mass production techniques resulting in extremely low cost. This is particularly important from the standpoint of producing a low cost curler assembly, which may be marketed as a "disposable curler assembly" thereby obviating the danger of transferring bacteria or disease from one user to another. The components are very lightweight for maximum comfort to the wearer; and the preferred materials minimize heat absorption for additional wearer comfort from the standpoint of reduced hair drying time. An important advantage of this assembly is that it requires no metal parts and no sharp components which may injure the wearer's scalp as by burns, abrasions or lacerations. Still another advantage is the convenience to the hair dresser, whether the wearer or a professional hairdresser, in that the fastener straps or components are attached to the curler body prior to use for ready fastening of the curler when the curl is rolled, obviating the necessity for reaching or searching for a fastening component. This assembly provides adequate tension for keeping the curler in place, but obviates hair breakage which results from excessive tension or spring clamping force.

While preferred embodiments of the invention have been illustrated and described, it will be understood by those skilled in the art that changes and modifications may be resorted to without departing from the spirit and scope of the invention.

What is claimed is:

1. A hair curler assembly comprising a generally cylindrical, hollow roller body having one end wall and one open end; said end wall having a small central opening; said body open end being defined by a generally smooth lip disposed in a transverse plane;

an elongated non-elastic fastener having head means at one end, comprising longitudinally spaced enlargements, dimensioned to be forced through said wall opening and to be retained by said end wall, and having hook means at its other end for engagement with said body lip at its open end.

2. A curler assembly as set forth in claim 1 said body being fabricated from a lightweight, heat insulating, moisture resistant material.

3. A curler assembly as set forth in claim 2 said body being fabricated from an open celled plastic material.

4. A curler assembly as set forth in claim 2 said roller body being fabricated from an open celled fibrous material.

5. A curler assembly as set forth in claim 2 said body being fabricated from an expanded synthetic resinous material.

6. A curler assembly as set forth in claim 1 said body being provided with a heat reflective exterior surface.

7. A curler assembly as set forth in claim 1 said fastener comprising a strap fabricated from a flexible sheet material.

8. A curler assembly as set forth in claim 7 said fastener strap being fabricated from a sheet plastic material.

9. A curler assembly as set forth in claim 7 said fastener strap head means being provided by serrations along at least one edge of said strap beginning adjacent to said one end and defining alternating areas of greater and lesser width.

10. A curler assembly as set forth in claim 9 said areas of lesser width having a width slightly less than the diameter of said end wall opening.

* * * * *